US011003110B2

(12) United States Patent
Suzuki et al.

(10) Patent No.: US 11,003,110 B2
(45) Date of Patent: May 11, 2021

(54) DEVELOPING DEVICE

(71) Applicant: CANON KABUSHIKI KAISHA, Tokyo (JP)

(72) Inventors: Hideaki Suzuki, Tokyo (JP); Shunsuke Tsuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/007,353

(22) Filed: Aug. 31, 2020

(65) Prior Publication Data

US 2021/0063914 A1 Mar. 4, 2021

(30) Foreign Application Priority Data

Sep. 4, 2019 (JP) ..... JP2019-161570

(51) Int. Cl.
*G03G 15/08* (2006.01)

(52) U.S. Cl.
CPC ..... *G03G 15/0891* (2013.01); *G03G 15/0844* (2013.01); *G03G 15/0893* (2013.01); *G03G 2215/083* (2013.01); *G03G 2215/0819* (2013.01); *G03G 2215/0822* (2013.01)

(58) Field of Classification Search
CPC ..... G03G 15/0891; G03G 15/0893; G03G 15/0898; G03G 15/0844; G03G 2215/0819; G03G 2215/0822; G03G 2215/083; G03G 2215/0827; G03G 2215/0838
See application file for complete search history.

(56) References Cited

U.S. PATENT DOCUMENTS 5,450,169 A * 9/1995 Hart ..... G03G 15/0822 399/104
9,098,018 B2 * 8/2015 Kashimoto ..... G03G 15/0891
9,811,026 B2 * 11/2017 Iida ..... G03G 15/0844
10,012,928 B2 7/2018 Iwata
2010/0061772 A1 * 3/2010 Hayashi ..... G03G 15/0877 399/263

(Continued)

FOREIGN PATENT DOCUMENTS

JP 2015-094816 A 5/2015
JP 2016-053715 A 4/2016

(Continued)

*Primary Examiner* — Walter L Lindsay, Jr.
*Assistant Examiner* — Laura Roth
(74) *Attorney, Agent, or Firm* — Venable LLP

(57) ABSTRACT

A developing device includes a first conveyance screw including a first blade portion and a second blade portion, the first blade portion configured to convey the developer in a first direction, the second blade portion being disposed downstream of the first blade portion in the first direction and configured to convey the developer in a second direction, a discharge path through which the developer passes to be discharged through a discharge port, and a magnet. The first conveyance screw includes a third blade portion disposed in the discharge path and configured to convey the developer in the first direction. The discharge port is disposed downstream of an upstream end of the third blade portion in the first direction. The magnet is disposed downstream of an upstream end of the discharge port in the first direction so as to overlap with the discharge port in the first direction.

10 Claims, 21 Drawing Sheets

(56) References Cited

U.S. PATENT DOCUMENTS

| | | | | |
|---|---|---|---|---|
| 2015/0030354 | A1* | 1/2015 | Ishida | G03G 15/0921 399/254 |
| 2019/0278199 | A1* | 9/2019 | Koga | G03G 15/0891 |

FOREIGN PATENT DOCUMENTS

| | | | |
|---|---|---|---|
| JP | 2016-194623 | A | 11/2016 |
| JP | 2018-097255 | A | 6/2018 |

* cited by examiner

DEVELOPING DEVICE

BACKGROUND OF THE INVENTION

Field of the Invention

The present invention relates to a developing device.

Description of the Related Art

In an image forming apparatus employing an electrophotographic system or the like, an electrostatic latent image formed on a photosensitive drum is developed into a toner image by a developing device. As such a developing device, a developing device using a two-component developer containing toner and carrier has been conventionally used. In a developing device using a two-component developer, a so-called trickle developing system is widely used as disclosed in, for example, Japanese Patent Application Laid-Open No. 2016-194623. In the trickle developing system, for the purpose of suppressing deterioration of carrier particles, replenishment is performed by using toner containing a small amount of carrier while discharging excess developer through a discharge port.

In a developing device, sometimes the internal pressure of a developer container increases during operation and air flows out through the discharge port, and developer in the developer container is excessively discharged by this airflow. Japanese Patent Application Laid-Open No. 2016-194623 discloses a configuration in which a regulation portion that regulates the flow out of the airflow from the discharge port is provided for suppressing excessive discharge of the developer caused by the airflow. In the case of the configuration disclosed in Japanese Patent Application Laid-Open No. 2016-194623, part of the regulation portion is defective, the developer is discharged through this defective region, and an upper space where no developer is present is blocked by a region where the regulation portion is not defective.

However, in the case of the configuration disclosed in Japanese Patent Application Laid-Open No. 2016-194623, since a region where part of the regulation portion is defective is provided, there is a possibility that a small gap is generated in a path to the discharge port. In the case of further increasing the speed of the developing device, there is a possibility that air flows out through the small gap and excess discharge of developer occurs.

SUMMARY OF THE INVENTION

According to one aspect of the present invention, a developing device includes a developer bearing member configured to bear and convey a developer containing toner and carrier for developing an electrostatic latent image formed on an image bearing member, a developer container including a first chamber and a second chamber and configured to accommodate the developer supplied to the developer bearing member, the second chamber being partitioned from the first chamber by a partition wall, a first conveyance screw including a first blade portion and a second blade portion, the first blade portion being disposed in the first chamber and configured to convey the developer in a first direction, the second blade portion being disposed downstream of the first blade portion in the first direction in the first chamber and configured to convey the developer in a second direction opposite to the first direction to deliver the developer from the first chamber to the second chamber, a second conveyance screw disposed in the second chamber and configured to convey the developer in the second direction, a discharge path which is disposed downstream of the second blade portion in the first direction, includes a discharge port for discharging part of the developer accommodated in the developer container from the developing device, and is connected to a downstream end of the first chamber in the first direction, and through which the developer passes to be discharged through the discharge port, and a magnet. The first conveyance screw further includes a third blade portion disposed in the discharge path and downstream of the second blade portion in the first direction and configured to convey the developer in the first direction. The discharge port is disposed downstream of an upstream end of the third blade portion in the first direction. The magnet is disposed downstream of an upstream end of the discharge port in the first direction so as to overlap with the discharge port in the first direction.

Further features of the present invention will become apparent from the following description of exemplary embodiments with reference to the attached drawings.

DESCRIPTION OF THE EMBODIMENTS

First Exemplary Embodiment

Figure 1:
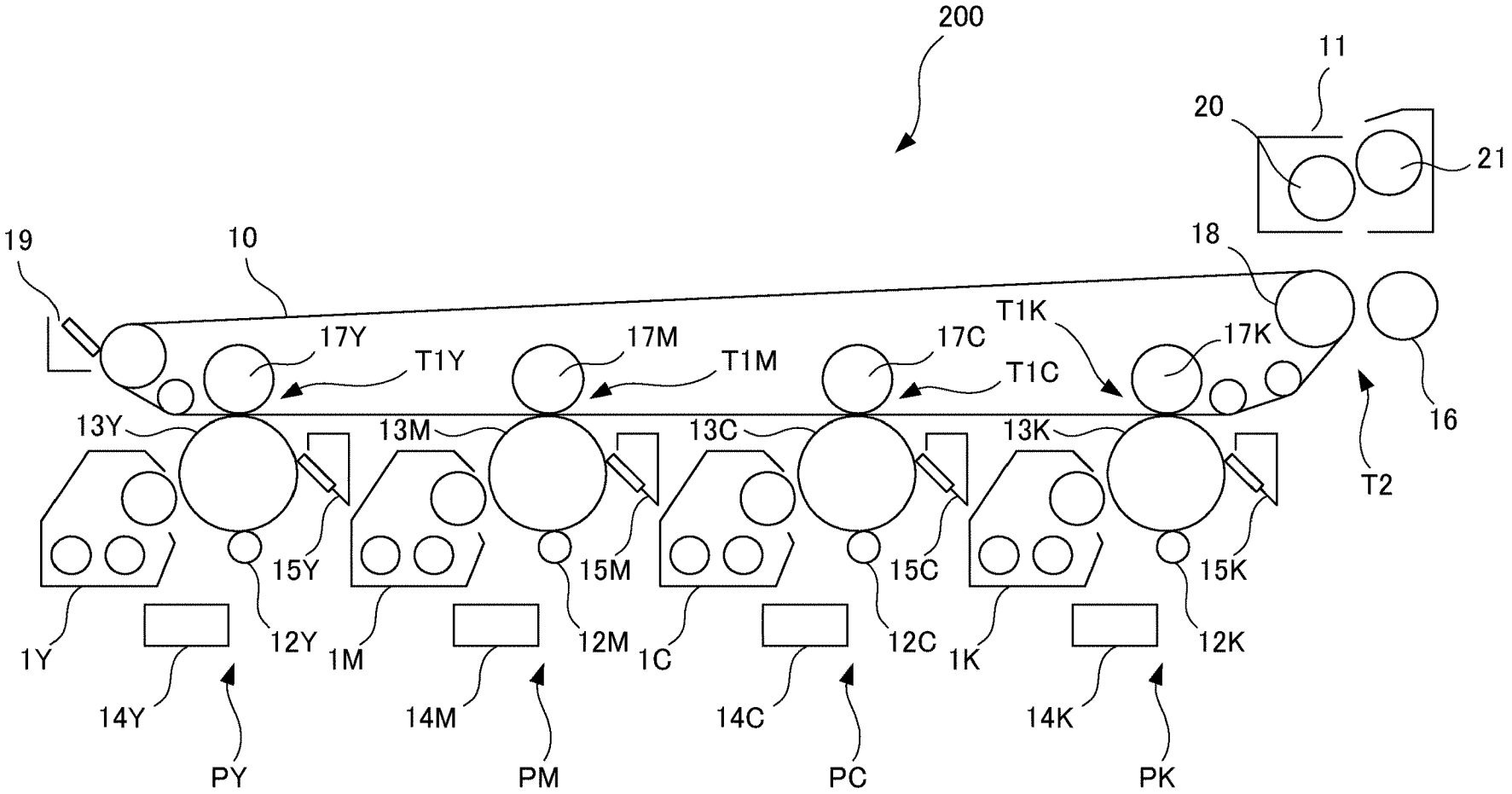
FIG. 1 is a schematic configuration diagram of an image forming apparatus according to a first exemplary embodiment.

A first exemplary embodiment will be described with reference to FIGS. 1 to 12. First, a schematic configuration of an image forming apparatus of the present exemplary embodiment will be described with reference to FIG. 1.

Image Forming Apparatus

An image forming apparatus 200 is a full-color printer of an electrophotographic system including four image forming portions PY, PM, PC, and PK respectively provided in correspondence with four colors of yellow, magenta, cyan, and black. In the present exemplary embodiment, an image forming apparatus of a tandem type in which the image forming portions PY, PM, PC, and PK are arranged along a rotation direction of an intermediate transfer belt 10 that will be described later is employed. The image forming apparatus 200 forms a toner image on a recording material in accordance with an image signal received from an unillustrated document reading apparatus connected to an image forming apparatus body or received from a host device such as a personal computer communicably connected to the image forming apparatus body. Examples of the recording material include sheet materials such as paper sheets, plastic films, and cloths.

To give an overview of such an image forming process, first, the image forming portions PY, PM, PC, and PK respectively form toner images of respective colors on photosensitive drums 13Y, 13M, 13C, and 13K. The toner images of respective colors thus formed are transferred onto the intermediate transfer belt 10, and subsequently transferred onto the recording material from the intermediate transfer belt 10. The recording material onto which the toner image has been transferred is conveyed to the fixing unit 11, and the toner image is fixed to the recording material. Details will be described below.

To be noted, the four image forming portions PY, PM, PC, and PK included in the image forming apparatus 200 substantially have the same configuration except for the color that is developed thereby. Therefore, the image forming portion PY will be described below as a representative. Elements of other image forming portions will be indicated by replacing an affix "Y" of reference signs given to elements of the image forming portion PY respectively by M, C, and K, and description thereof will be omitted.

The image forming portion PY includes a cylindrical photosensitive member serving as an image bearing member, that is, the photosensitive drum 13Y. A charging roller 12Y serving as a charging device, a developing device 1Y, a primary transfer roller 17Y, and a cleaning unit 15Y are provided around the photosensitive drum 13Y. An exposing unit 14Y, which is a laser scanner, is provided below the photosensitive drum 13Y in FIG. 1.

The charging roller 12Y is rotationally driven by the photosensitive drum 13Y at the time of image formation. The charging roller 12Y is urged toward the photosensitive drum 13Y by an unillustrated pressurizing spring. In addition, a charging bias is applied to the charging roller 12Y from a high-voltage power source. As a result of this, the photosensitive drum 13Y is charged by the charging roller 12Y approximately uniformly.

In addition, the intermediate transfer belt 10 is disposed to oppose the photosensitive drums 13Y, 13M, 13C, and 13K. The intermediate transfer belt 10 is stretched over a plurality of stretching rollers, and circulates by being driven by a driving roller included in the plurality of stretching rollers. A secondary transfer outer roller 16 serving as a secondary transfer member is disposed at a position opposing a secondary transfer inner roller 18, which is included in the plurality of stretching rollers, with the intermediate transfer belt 10 therebetween, and thus a secondary transfer portion T2 at which the toner image on the intermediate transfer belt 10 is transferred onto the recording material is formed. The fixing unit 11 is disposed downstream of the secondary transfer portion T2 in a recording material conveyance direction. In addition, an unillustrated feeding portion is disposed in a lower portion of the image forming apparatus 200. The recording material fed from the feeding portion at the start of the image forming operation is conveyed to the secondary transfer portion T2 at a predetermined timing.

A process of forming an image by the image forming apparatus 200 configured as described above will be described. First, when the image forming operation is started, the surface of the rotating photosensitive drum 13Y is uniformly charged by the charging roller 12Y. Then, the photosensitive drum 13Y is exposed to laser light corresponding to an image signal and emitted from the exposing unit 14Y. As a result of this, an electrostatic latent image corresponding to the image signal is formed on the photosensitive drum 13Y. The electrostatic latent image on the photosensitive drum 13Y is visualized with toner accommodated in the developing device 1Y, and becomes a visible image, which is a toner image.

The toner image formed on the photosensitive drum 13Y is transferred onto the intermediate transfer belt 10 through primary transfer at a primary transfer portion T1Y formed between the photosensitive drum 13Y and the primary transfer roller 17Y arranged with the intermediate transfer belt 10 therebetween. Toner remaining on the surface of the photosensitive drum 13Y after the primary transfer, that is, transfer residual toner, is removed by the cleaning unit 15Y.

Such an operation is also sequentially performed in the respective image forming portions of magenta, cyan, and black, and toner images of four colors are superposed on one another on the intermediate transfer belt 10. Then, a recording material accommodated in an unillustrated recording material accommodating cassette of the feeding portion is conveyed to the secondary transfer portion T2 so as to match the timing of formation of the toner images, and the toner images of four colors on the intermediate transfer belt 10 are collectively transferred onto the recording material. Toner remaining on the intermediate transfer belt 10 without being transferred in the secondary transfer portion T2 is removed by an intermediate transfer belt cleaner 19.

Next, the recording material is conveyed to the fixing unit 11. The fixing unit 11 includes a fixing roller 20 including a heat source such as a halogen heater therein and a pressurizing roller 21, and the fixing roller 20 and the pressurizing roller 21 form a fixing nip portion. The recording material conveyed to the fixing unit 11 is caused to pass through the fixing nip portion, and thus the toner image is fixed to the recording material. Then, the recording material is discharged to the outside of the apparatus. In this manner, the series of steps of the image forming process are finished. To be noted, a monochromatic image of a desired color or an image of a plurality of desired colors can be also formed by using only a desired image forming portion or only desired image forming portions.

Developer

Here, a two-component developer used in the present exemplary embodiment will be described. As the developer, a mixture of nonmagnetic toner having a negative charging polarity and magnetic carrier having a positive charging polarity is used. The nonmagnetic toner is obtained by attaching fine particles of titanium oxide, silica, or the like to the surface of a powder of resin encapsulating a colorant, a wax component, and the like. Examples of the resin include polyester and styrene acrylic resin, and the powder is obtained by pulverization or polymerization. The magnetic carrier is obtained by forming a resin coating on the surface layer of a core formed from a resin particle into which ferrite particles or magnetic powder are kneaded.

Developing Device

Figure 2:
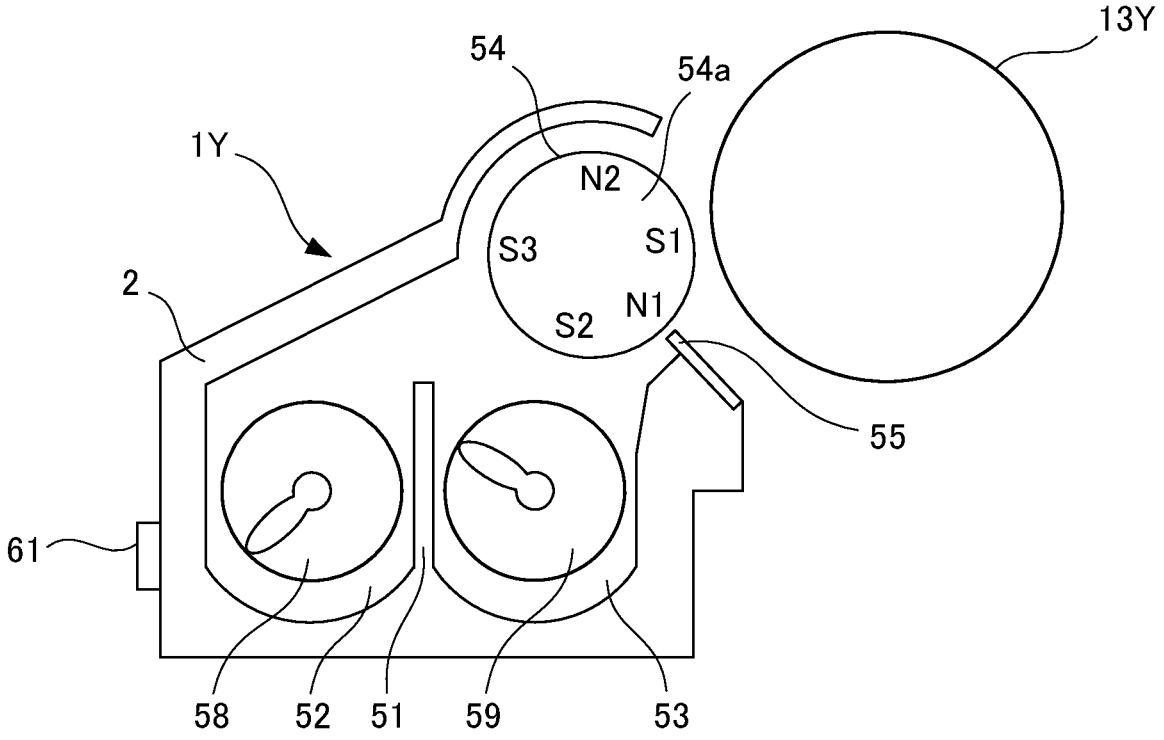
FIG. 2 is a schematic section view of a developing device and a photosensitive drum according to the first exemplary embodiment illustrating a configuration thereof.

Next, details of the configuration of the developing device 1Y will be described with reference to FIGS. 2 and 3. To be noted, the same applies to developing devices 1M, 1C, and 1K. The developing device 1Y includes a developer container 2 accommodating the developer containing magnetic carrier and nonmagnetic toner, and a developing sleeve 54 serving as a developer bearing member that bears and conveys the developer in the developer container 2. The developing sleeve 54 is rotatably held, and a magnet roller 54*a* including a plurality of magnetic poles S1, S2, S3, N1, and N2 is non-rotatably provided in a space enclosed by the developing sleeve 54.

The developer container 2 is partitioned into a first conveyance path 52 serving as a first chamber and an agitation chamber, and a second conveyance path 53 serving as a second chamber and a developing chamber by a partition wall 51, and the first conveyance path 52 and the second conveyance path 53 communicate with each other through communication ports provided at both end portions of the partition wall 51. As a result of this, the first conveyance path 52 and the second conveyance path 53 constitute a circulation path of the developer. That is, the developer is delivered from the first conveyance path 52 to the second conveyance path 53 through one of the communication ports, and the developer is delivered from the second conveyance path 53 to the first conveyance path 52 through the other of the communication ports.

The developer container 2 includes two screw members serving as conveyance members that convey the developer while agitating the developer. That is, a first conveyance screw 58 is provided in the first conveyance path 52, and a second conveyance screw 59 is provided in the second conveyance path 53. The first and second conveyance screws 58 and 59 respectively include rotation shafts 58*a* and 59*a* and blades 58*b* and 59*b* provided in spiral shapes around the rotation shafts 58*a* and 59*a*, that is, on the rotation shafts.

When the first conveyance screw 58 rotates around the rotation shaft 58*a*, the spiral blade 58*b* conveys the developer in the first conveyance path 52 in the direction of an arrow α serving as a first direction, which is toward a first side in the longitudinal direction of the developing device 1Y, that is, the axial direction of the rotation shaft 58*a*. When the second conveyance screw 59 rotates around the rotation shaft 59*a*, the spiral blade 59*b* conveys the developer in the second conveyance path 53 in the direction of an arrow β serving as a second direction, which is toward a second side in the longitudinal direction of the developing device 1Y, that is, the axial direction of the rotation shaft 58*a*. As a result of this, the developer is circulated in the first conveyance path 52 and the second conveyance path 53.

The developing device 1Y includes a toner concentration sensor 61 serving as a concentration detection portion configured to detect the toner concentration in the developer container 2. The toner concentration sensor 61 is a magnetic permeability sensor, and the toner concentration detected herein is a ratio of the weight of toner particles to the total weight of carrier particles and toner particles, that is, a T/D ratio. The toner concentration sensor 61 is provided at a predetermined position in the first conveyance path 52 in the first direction, and detects the toner concentration in the first conveyance path 52. In the present exemplary embodiment, an inductance sensor is used as the toner concentration sensor 61, and a sensor surface, that is, a detection surface of the inductance sensor is exposed in the first conveyance path 52. The inductance sensor detects magnetic permeability in a predetermined detection range from the sensor surface. When the toner concentration of the developer changes, the magnetic permeability derived from the mixture ratio of the magnetic carrier and the nonmagnetic carrier also changes, and therefore the toner concentration can be detected by detecting the change in the magnetic permeability by the inductance sensor.

The developer in the second conveyance path 53 is scooped up into the range of the magnetic force of the S2 pole by the second conveyance screw 59 provided below the developing sleeve 54 in the second conveyance path 53, and is born on the developing sleeve 54. The developer born on the developing sleeve 54 is conveyed in accordance with the rotation of the surface of the developing sleeve 54. A regulation blade 55 serving as a member that forms a thin layer of developer is disposed in the vicinity of the N1 pole of the developing sleeve 54 with a predetermined gap between the regulation blade 55 and the surface of the developing sleeve 54. The gap between the developing sleeve 54 and the regulation blade 55 is generally set to about 200 μm to 500 μm, and the amount of developer born on the developing sleeve 54 is larger when the gap is wider.

The conveyed developer forms a magnetic brush at the N1 pole, and a thin layer of a desired amount of developer is formed on the surface of the developing sleeve 54 by the regulation blade 55 disposed with a predetermined interval from the developing sleeve 54. Then, the developer conveyed to a portion opposing the photosensitive drum 13Y forms a magnetic brush again at the S1 pole, and a developing nip is formed between the developing sleeve 54 and the photosensitive drum 13Y.

The surface of the photosensitive drum 13Y is charged to a certain potential by the charging roller 12Y, and an image portion is exposed by the exposing unit 14Y to have an exposed potential. Meanwhile, a developing bias is applied to the developing sleeve 54 via an unillustrated high-voltage circuit. The developing bias is, for example, a bias in which a rectangular alternate current waveform is superimposed on a direct current waveform of a constant voltage. Toner charged in the developing device 1Y receives a driving force derived from the potential difference between the developing bias and the potential of the surface of the photosensitive drum 13Y and attaches to the exposed portion, and thus a developing step is completed.

Toner not used for the development and the carrier are conveyed further downstream in the rotation direction of the developing sleeve 54, lose the magnetic binding force in a zero gauss band formed between the S2 pole and the S3 pole where the magnetic flux density in the radial direction is zero, and are collected into the second conveyance path 53 again.

When the developing operation is performed, only toner is consumed from the developer, and thus the weight ratio of toner to the developer, that is, the T/D ratio is reduced. Therefore, the T/D ratio is controlled to a predetermined value by performing a toner replenishing operation. In the present exemplary embodiment, the predetermined T/D ratio is 8%.

Figure 3:
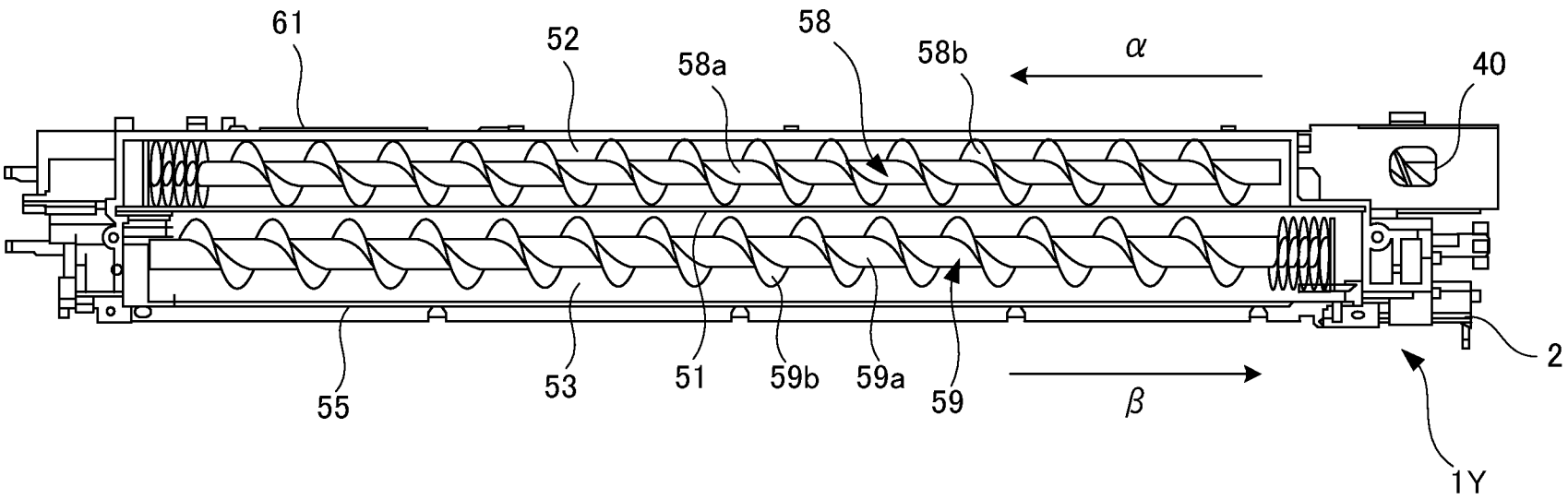
FIG. 3 is a partially omitted plan view of the developing apparatus according to the first exemplary embodiment.
Figure 4:
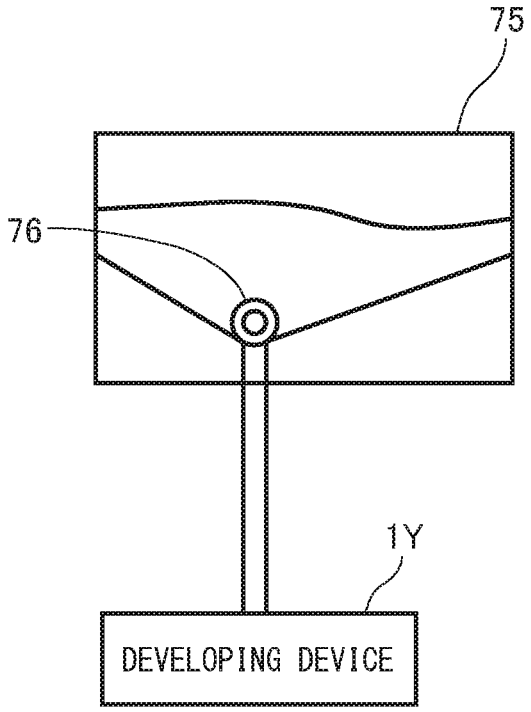
FIG. 4 is a schematic view of a configuration for developer replenishment according to the first exemplary embodiment.

As illustrated in FIG. 4, a hopper 75 accommodating a replenishing developer including toner and magnetic carrier is disposed above the developing device 1Y, and toner of an amount used in the image formation can be supplied to the developing device 1Y. The amount of toner replenishment is controlled by an unillustrated controller rotating a supply screw 76. Specifically, the controller calculates the amount of toner consumption in the image formation on the basis of a result of magnetically detecting the T/D ratio in the developer container 2 by the toner concentration sensor 61 illustrated in FIGS. 2 and 3, and determines the amount of toner replenishment. To be noted, for example, a result of forming a toner image for control, which is a patch image in this case, on the intermediate transfer belt 10 each time image formation is performed on a predetermined number of sheets and detecting the toner image for control by an unillustrated reflection concentration sensor may be also used for determination of the amount of toner replenishment.

The toner replenishment is performed through a toner replenishment port 40 illustrated in FIG. 3 provided in the developer container 2. In the present exemplary embodiment, the toner replenishment port 40 is provided at the upstream end portion of the first conveyance screw 58 in the first direction and above a conveyance path range of the first conveyance path 52. However, it can be considered that the position of the toner replenishment port differs depending on the configuration of the image forming apparatus or the like, and the position of the toner replenishment port is not limited to this. The toner supplied for replenishment circulates in the first conveyance path 52 and the second conveyance path 53 while being agitated and conveyed together with the developer by the first conveyance screw 58 and the second conveyance screw 59.

Trickle Developing System

In the developing device 1Y of the present exemplary embodiment, a trickle developing system for suppressing deterioration of the carrier in the developer is employed. In the description below, the trickle developing system will be simply referred to as a trickle. The trickle is a developing system in which, when the volume of the developer in the developer container 2 reaches a certain value or more, excess developer is discharged through a discharge port 100 provided in the developer container 2 illustrated in FIG. 8 and so forth, and the carrier is replenished by a small amount of carrier included in the replenishing toner.

Figure 5A:
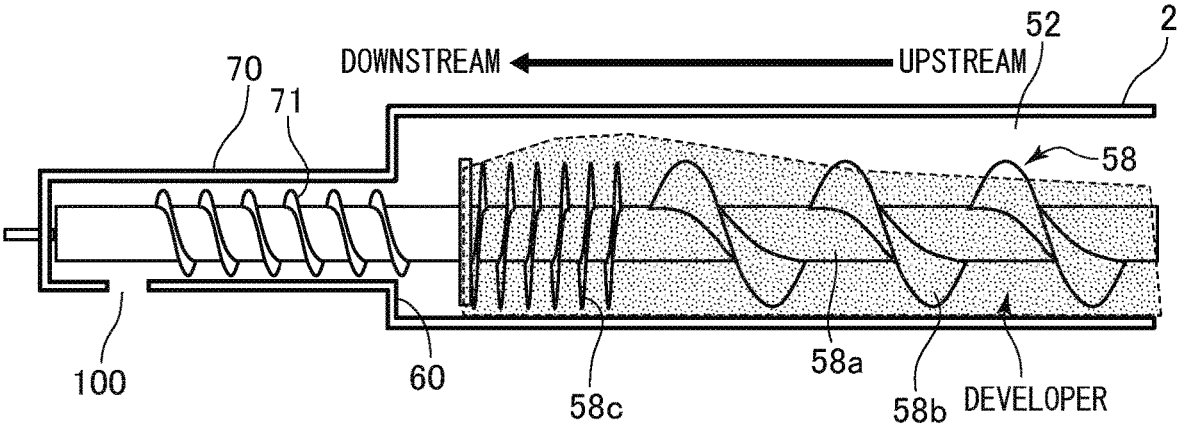
FIG. 5A is a schematic diagram illustrating a state in which a developer surface is low.
Figure 5B:
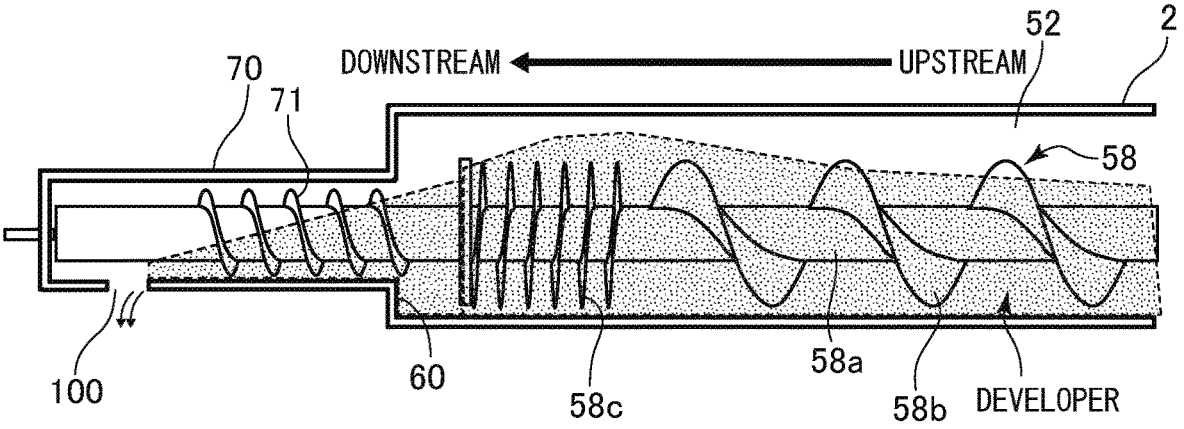
FIG. 5B is a schematic diagram illustrating a state in which the developer surface is at a certain height or higher.

FIGS. 5A and 5B are diagrams for describing an example of a configuration and mechanism of a typical trickle. In the description below, terms "upstream" and "downstream" refer to upstream and downstream in the conveyance direction by the blade 58*b* of the first conveyance screw 58. The conveyance direction by the blade 58*b* serves as a first direction, and the upstream side and the downstream side thereof are respectively the right side and the left side in FIGS. 5A and 5B.

The first conveyance screw 58 includes the rotation shaft 58*a*, the blade 58*b* serving as a first blade portion that conveys the developer in the first conveyance path 52 in the first direction, and a reverse conveyance portion 58*c* serving as a second blade portion that pushes back the developer to the upstream side at the downstream end portion of the first conveyance screw 58. The reverse conveyance portion 58*c* is a blade portion that is disposed downstream of the blade 58*b* in the first direction for conveying the developer in the second direction opposite to the first direction and delivering the developer from the first conveyance path 52 to the second conveyance path 53. A discharge path 70 for discharging excess developer is connected to the downstream side of the first conveyance path 52, and a discharge port 100 is opened on the downstream side and lower side in the gravity direction of the discharge path 70. The discharge path 70 is provided outside the circulation path in the developer container 2, and is connected to the first conveyance path 52.

A discharge conveyance portion 71 serving as a third blade portion is provided in the discharge path 70. The discharge conveyance portion 71 is a conveyance screw formed by forming a spiral blade on the rotation shaft 58*a*, which is also the rotation shaft of the first conveyance screw 58, and has a function of conveying the developer downstream toward the discharge port 100. The inner diameter of the discharge path 70 is set to be smaller than the inner diameter of the first conveyance path 52, and the outer diameter of the discharge conveyance portion 71 is set to be smaller than the outer diameter of the blade 58*b*.

In FIGS. 5A and 5B, dotted parts schematically indicate regions where the developer is present. As illustrated in FIG. 5A, when the volume of the developer in the first conveyance path 52 is small and the developer surface is low, all of the developer conveyed by the blade 58*b* is pushed back by the reverse conveyance portion 58*c*. Meanwhile, as illustrated in FIG. 5B, when the volume of the developer in the first conveyance path 52 has increased and the height of the developer surface has risen to a certain height or more, some developer is not pushed back by the reverse conveyance portion 58*c* and moves beyond the reverse conveyance portion 58*c*. Then, when the developer having moved beyond the reverse conveyance portion 58*c* is accumulated enough to go over a step 60 provided between the first conveyance path 52 and the discharge path 70, it becomes possible to convey the accumulated developer by the discharge conveyance portion 71, and the accumulated developer is delivered to and discharged through the discharge port 100 as excess developer.

Figure 6:
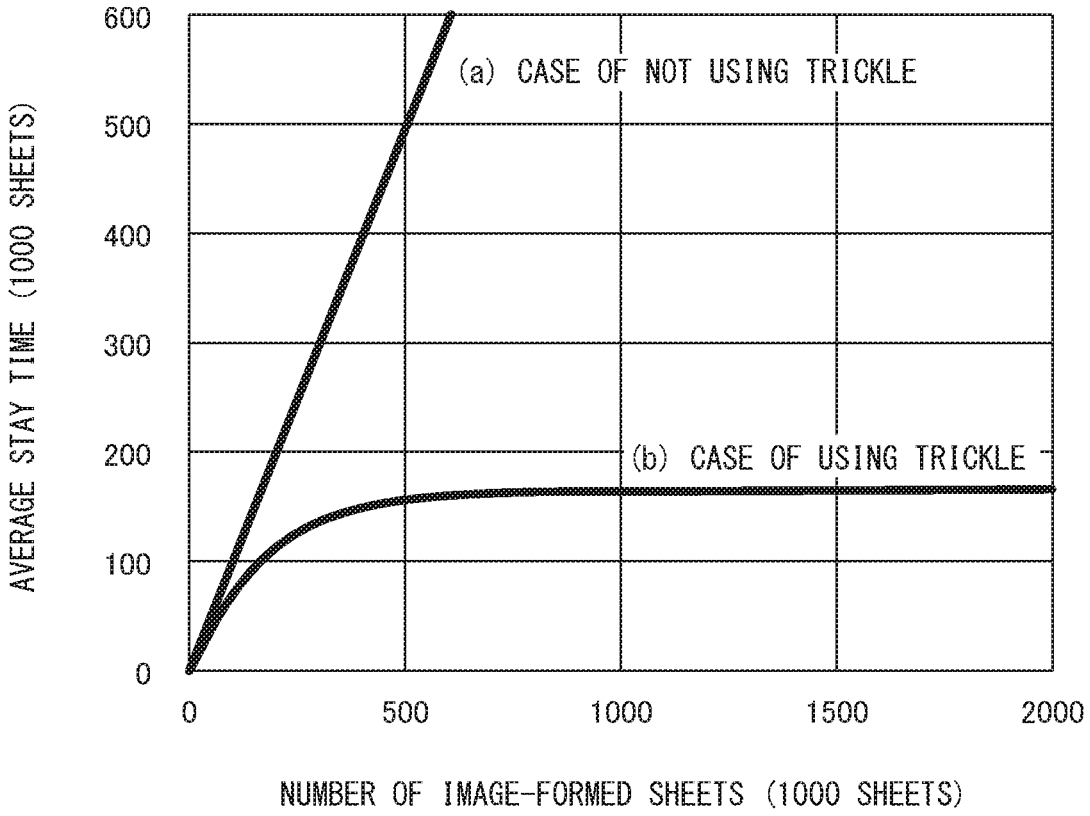
FIG. 6 is a graph showing a relationship between the number of image-formed sheets and the average stay time of developer in the case where a trickle developing system is used and the case where the trickle developing system is not used.

It is known that, as the use of the developing device 1Y progresses, external additives contained in the toner attaches to the surface of the carrier, and thus the chargeability of the carrier becomes degraded. FIG. 6 is a graph showing calculation results of an average stay time of the carrier in the developer container 2 representing the degree of deterioration of the carrier. In FIG. 6, (a) represents a case where the trickle is not used, and (b) represents a case where the trickle is used. This calculation was performed in conditions of an image density of 5%, a developer amount of 250 g in the developer container 2, a T/D ratio of 8% in the developer, and a carrier weight ratio of 10% in the replenishing toner.

In (a) of FIG. 6, the average stay time increases proportionally to the use time represented by the number of image-formed sheets. In contrast, in (b) of FIG. 6, since old carrier is consumed and replenishment with new carrier is performed, the average stay time of the carrier is shorter than the case of (a), and settles at a certain time. This time will be referred to as a saturation stay time. That is, the deterioration of the carrier does not progress beyond a certain degree, and the toner chargeability of the carrier can be maintained.

As described above, in the trickle developing system, a small amount of carrier is included in the replenishing toner. Therefore, when the amount of developer in the developer container 2 increases in accordance with the replenishment operation and the volume thereof exceeds a certain value, part of the developer is spilled beyond the reverse conveyance portion 58*c*, and the developer is discharged through the discharge port 100. According to the system described above in which the discharge is stopped in the case where the volume of the developer is small and the discharge is performed in the case where the volume is large, the amount of developer in the developer container 2 is maintained within a certain range.

Excessive Discharge of Developer

Figure 7:
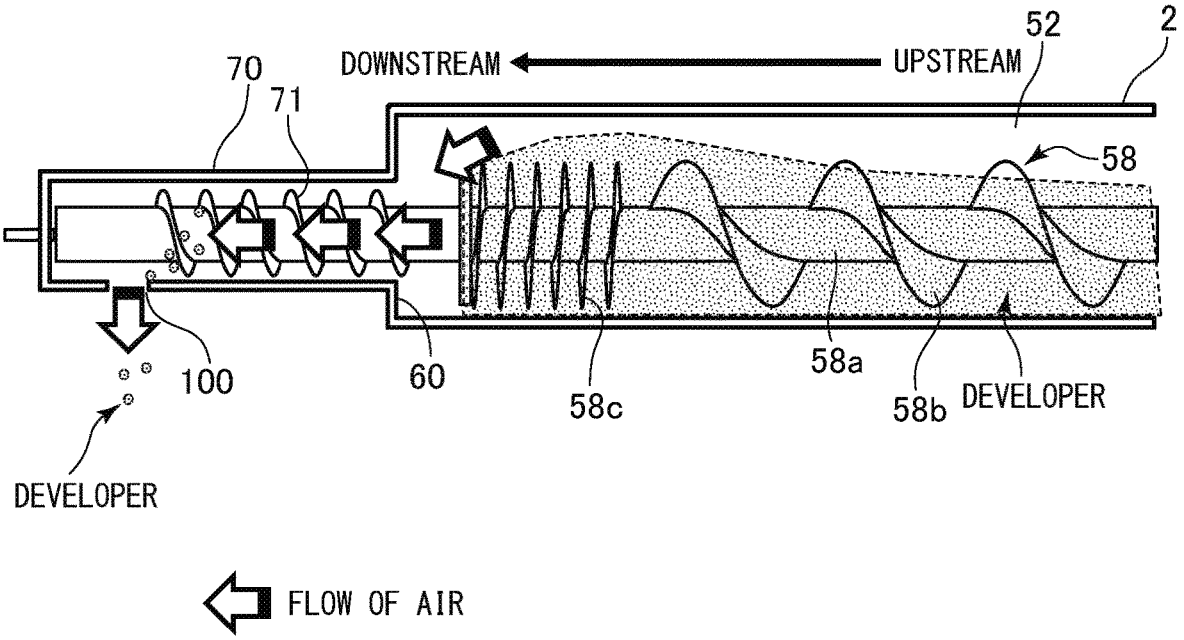
FIG. 7 is a schematic diagram for describing a mechanism of excessive discharge of developer in the case where the trickle developing system is employed.

As described above, the trickle developing system is a technique effective for suppressing deterioration of the carrier in the developer. However, sometimes more developer than expected is discharged in the trickle developing system. For example, in the case where the driving speed of the developing device 1Y is increased in accordance with the acceleration of the image forming apparatus in recent years, the amount of air taken into the developer container 2 in accordance with the rotation of the developing sleeve 54 increases, and the inner pressure of the developer container 2 increases. As a result of the inner pressure of the developer container 2 increasing while the outside of the developer container 2 is at the atmospheric pressure, a pressure difference is generated between the inside and the outside, and an airflow blowing out of the developer container 2 through the discharge port 100 is generated as illustrated in FIG. 7. Since this airflow includes developer pushed up by the screw, the developer reaches the discharge path 70 and is conveyed downstream by the discharge conveyance portion 71. In this manner, a small amount of developer flows out through the discharge port 100 even in the case where the volume of the developer is not large and the developer is not supposed to be discharged.

In the case where the state of "excessive discharge" in which the trickle discharge is performed even though the volume of the developer is small continues as described above, the amount of developer in the developer container 2 gradually decreases, and there is a risk that it becomes impossible to sufficiently supply the developer to the developing sleeve 54.

Measure against Excessive Discharge of Developer

Figure 8:
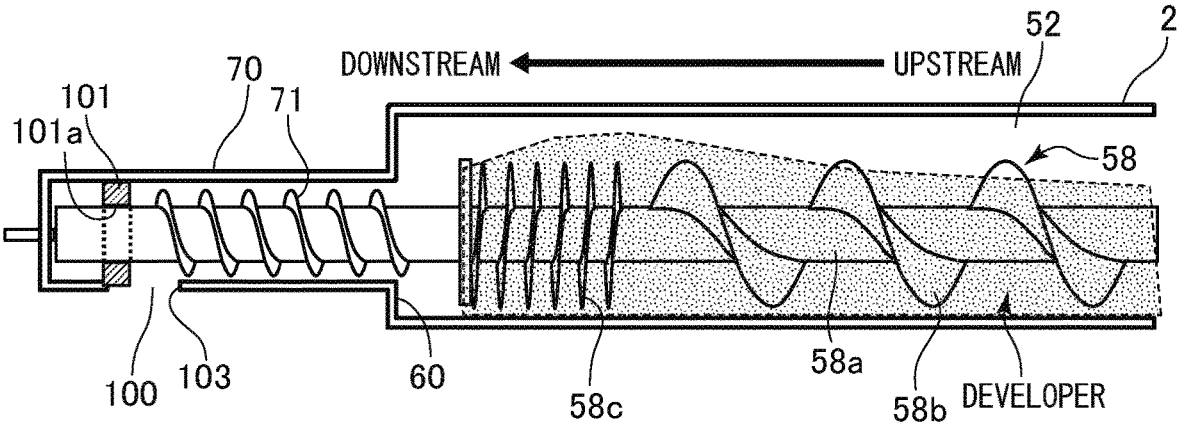
FIG. 8 is a schematic view of a part of a first conveyance path and a discharge path of the developing device according to the first exemplary embodiment.

Therefore, in the present exemplary embodiment, as illustrated in FIG. 8, a ring-shaped magnet 101 serving as a magnetic field generation portion is disposed downstream of an end portion of the discharge port 100 in the conveyance direction of the discharge conveyance portion 71, and thus excessive discharge of the developer in the developer container 2 is suppressed. The details will be described below. To be noted, in the description below, "upstream" and "downstream" in the discharge path 70 respectively correspond to upstream and downstream in the developer conveyance direction of the discharge conveyance portion 71.

First, also in the case of the configuration of the present exemplary embodiment, the first conveyance screw 58 that conveys the developer in the first conveyance path 52 in the first direction includes the rotation shaft 58*a* and the blade 58*b* serving as a first blade portion provided in a spiral shape on the rotation shaft 58*a*. In addition, the discharge conveyance portion 71 serving as a third blade portion is provided downstream of the blade 58*b* in the first direction, and conveys the developer toward the discharge port 100. The discharge conveyance portion 71 is constituted by providing the spiral blade on the rotation shaft 58*a*, and conveys the developer in the same direction as the first direction. Further, the reverse conveyance portion 58*c* that conveys the developer in the second direction opposite to the first direction is provided between the blade 58*b* and the discharge conveyance portion 71 in the first direction. The reverse conveyance portion 58*c* is also a blade provided in a spiral shape on the rotation shaft 58*a*.

Particularly, in the case of the present exemplary embodiment, the magnet 101 is disposed downstream of an upstream end 103 of the discharge port 100 in the developer conveyance direction of the discharge conveyance portion 71. The magnet 101 has a ring-like shape, and the entirety of the outer circumference thereof is fixed to the inner wall surface of the discharge path 70 at a position downstream of the discharge conveyance portion 71. Specifically, the magnet 101 is disposed with a predetermined interval from the upstream end 103 of the discharge port 100 in the first direction.

Figure 9:
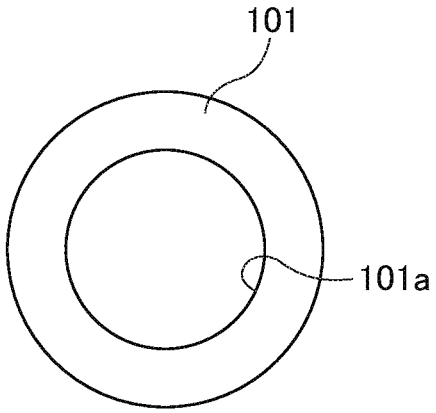
FIG. 9 is a plan view of a magnet according to the first exemplary embodiment.

The ring-shaped magnet 101 has a shape as illustrated in FIG. 9, and has an outer diameter of 14 mm, an inner diameter of 8 mm, and a thickness of 1.5 mm in the present exemplary embodiment. In addition, the rotation shaft 58*a* penetrates through the center of the magnet 101. As a result of this, the magnet 101 is configured such that the entirety of an inner circumferential surface 101*a* thereof oppose the outer circumferential surface of the rotation shaft 58*a* with a small gap therebetween.

As the magnet 101, a magnet magnetized such that one surface thereof is an S pole and the other surface thereof is an N pole and having a surface magnetic flux density of 50 mT to 60 mT as measured with GX-100 manufactured by Nihon Denji Sokki Co., Ltd. is used. In addition, in the present exemplary, the magnet 101 is disposed such that the N pole surface thereof is on the discharge port 100 side, but either pole may be on the discharge port 100 side. When the magnetic flux density of the magnet 101 is too large, there is a possibility that attached developer is strongly rubbed on the rotation shaft 58*a* of the discharge conveyance portion 71 and toner adheres thereto, and when the magnetic flux density is too small, the effect of the present exemplary embodiment cannot be obtained. Therefore, although the magnetic flux density is set within the range described above in the present exemplary embodiment, the magnetic flux density can be appropriately set in accordance with the configuration of the apparatus.

The developer conveyed by the discharge conveyance portion 71 is discharged by falling through the discharge port 100, but part of the developer to be discharged is attracted by the magnetic force of the magnet 101 and attaches to the surface of the magnet 101. As the amount of developer attached to the surface of the magnet 101 gradually increases, a developer accumulating region 102 is formed by the attached developer as illustrated in FIG. 10.

Figure 10:
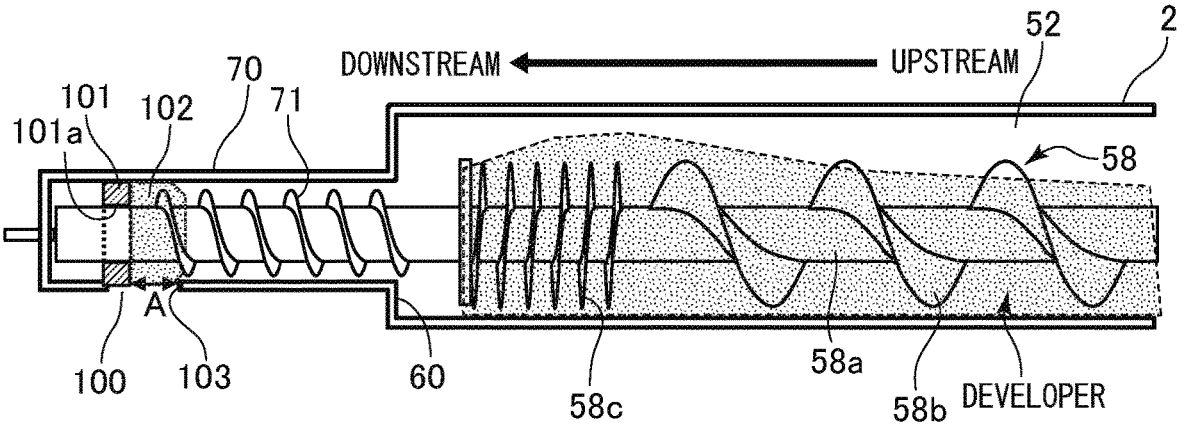
FIG. 10 is a schematic diagram for describing a developer accumulating region formed by a magnetic field of the magnet according to the first exemplary embodiment.

This developer accumulating region 102 is formed to extend in the direction of the upstream end 103 of the discharge port 100 from the magnet 101, that is, rightward in FIG. 10, and therefore the formed developer accumulating region 102 comes to cover the discharge port 100 as illustrated in FIG. 10. In the illustrated example, part of the magnet 101 is exposed to the discharge port 100, and the developer accumulating region 102 is formed to project to a position below the discharge port 100. That is, the magnet 101 is disposed downstream of the upstream end 103 of the discharge port 100 in the first direction so as to overlap with the discharge port 100 in the first direction. To be noted, the magnet 101 does not have to be exposed to the discharge port 100 as long as the magnet 101 is disposed such that the discharge port 100 is covered by the developer accumulating region 102.

When the discharge port 100 is covered by the developer accumulating region 102, the flow path through which air blows out of the developer container 2 from the discharge port 100 as illustrated in FIG. 7 is blocked by the developer accumulating region 102, and therefore the flow rate of the airflow flowing out can be reduced. Therefore, the developer discharged to the outside through the discharge port 100 by this airflow can be reduced.

Meanwhile, although the discharge port 100 is covered by the developer accumulating region 102, the developer conveyed by the discharge conveyance portion 71 is pushed into the developer accumulating region 102 by the conveyance force of the discharge conveyance portion 71. Further, since the developer is naturally discharged downward from the discharge port 100 by the gravity when the amount of developer that can be borne by the magnetic force of the magnet 101 is exceeded, clogging is not caused by the developer in the vicinity of the discharge port 100. In this manner, the excessive discharge of the developer by the airflow can be suppressed while maintaining the normal discharge of the developer by the discharge conveyance portion 71.

An interval A between the upstream end 103 of the discharge port 100 and the magnet 101 is set to 11.5 mm in the configuration of the present exemplary embodiment, and setting the interval A appropriately is important. The reason for this will be described below.

Figure 11A:
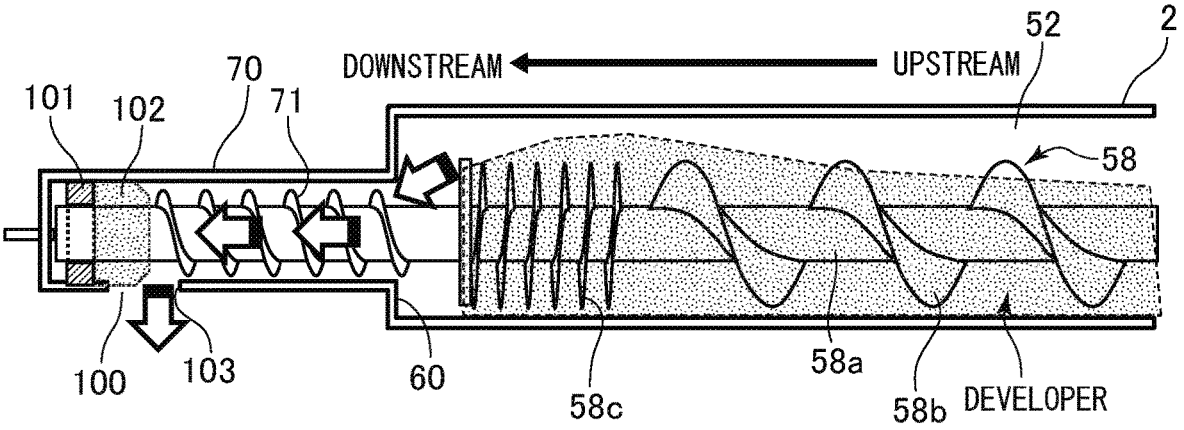
FIG. 11A is a schematic view of a first example of a relationship between the position of the magnet and a discharge port.

As illustrated in FIG. 11A, in the case where the interval A described above is set to be too large, the formed developer accumulating region 102 cannot sufficiently cover the discharge port 100. Therefore, a gap through which the airflow flows is generated, and therefore the airflow flowing out and the discharge of the developer by the airflow cannot be sufficiently suppressed.

Figure 11B:
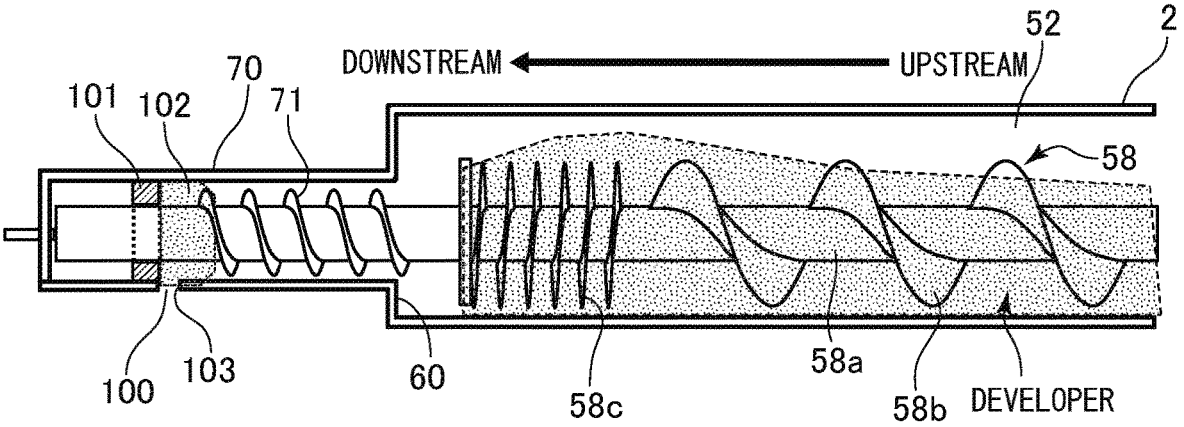
FIG. 11B is a schematic view of a second example of the relationship between the position of the magnet and the discharge port.

In contrast, in the case where the interval A is set to be too small as illustrated in FIG. 11B, the substantial opening width of the discharge port 100 is small, and therefore the amount of developer that can be discharged per unit time is also small. Therefore, in the case where the amount of supply of developer per unit time is large, for example, where images of high image coverage are successively formed, the amount of developer in the developer container 2 becomes excessive if the amount of developer that can be discharged is smaller than the amount of supply of developer. As a result, problems such as leakage of developer or failure of agitation of replenished toner can occur.

Therefore, the interval A is preferably set such that the distal end of the developer accumulating region 102 borne by the magnet 101 barely touches the upstream end 103 of the discharge port 100. Therefore, the interval A is set to 11.5 mm in the present exemplary embodiment. However, since the appropriate value of the interval A differs depending on the configuration near the discharge port 100, the size of the magnet 101, the magnetic force, and so forth, an appropriate value is set in accordance with the configuration of the developing device.

In addition, in the present exemplary embodiment, a magnetic material is used as the material of the rotation shaft 58*a* of the discharge conveyance portion 71. In the case where the material of the rotation shaft 58*a* is a magnetic body, the rotation shaft 58*a* penetrating through the center of the ring-shaped magnet 101 is magnetized by the magnetic force of the magnet 101, and therefore a magnetic seal is formed between the inner circumferential surface 101*a* of the magnet 101 and the rotation shaft 58*a*. Therefore, the developer slipping through the center of the ring-shaped magnet 101 can be suppressed by the magnetic seal.

To be noted, since it suffices as long as the developer accumulating region 102 formed by the magnet 101 covers an upper portion of the discharge port 100, a magnet having a shape obtained by cutting off an upper portion of the ring-shaped magnet 101, for example, a semicircular shape, can be also used. That is, it suffices as long as the magnet 101 is disposed at least in a range including one end to the other end of the opening of the discharge port 100 in the circumferential direction of the rotation shaft 58*a*. In other words, it suffices as long as the magnet 101 is positioned at the same phase as the discharge port 100 in the circumferential direction of the rotation shaft 58*a* and has a width equal to or larger than the width of the discharge port 100 as viewed in the axial direction of the rotation shaft 58*a*.

In addition, the magnet may be fixed to the rotation shaft 58*a*. In this case, the magnet is preferably provided over the entire circumference of the rotation shaft 59*a* such that a small gap is provided between the magnet and the inner circumferential surface of the discharge path 70. In addition, the magnet may be provided on the outer wall of the discharge path 70.

In this case, the developer accumulating region is formed in the discharge path 70 by forming the discharge path 70 as a nonmagnetic member such that the magnetic force acts on the inside of the discharge path 70.

In addition, the discharge conveyance portion 71, which is a spiral blade, is preferably disposed so as to extend further downstream than the upstream end 103 of the discharge port 100 in the conveyance direction as illustrated in FIG. 10. That is, the downstream end of the discharge conveyance portion 71 is preferably disposed downstream of the upstream end 103 of the discharge port 100. As a matter of course, the downstream end of the discharge conveyance portion 71 is positioned upstream of the magnet 101. By employing such a configuration, the developer accumulating region 102 can be pushed in the conveyance direction by the conveyance force of the discharge conveyance portion 71 more reliably, and therefore the developer can be discharged more reliably also in the case where the amount of supply of developer is large.

In addition, in the case of the present exemplary embodiment, since the magnet 101 is positioned downstream of the upstream end 103 of the discharge port 100 and the downstream end of the discharge conveyance portion 71, the developer is not likely to reach a position downstream of the magnet 101 in the discharge path 70. Therefore, a sealing member such as an oil seal normally provided at the downstream end of the discharge path 70 for preventing the leakage of developer may be omitted.

EXAMPLE

Figure 12:
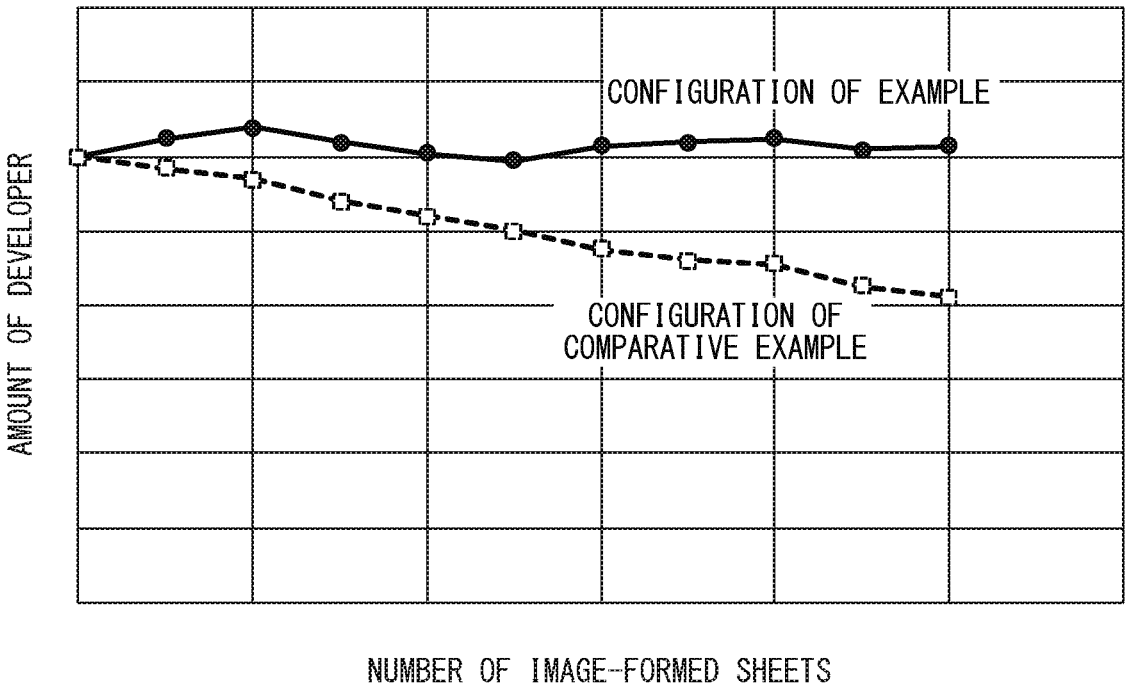
FIG. 12 is a graph showing transition of the amount of developer in the developing device of an example and a comparative example.

Next, an experiment conducted for confirming the effect of the present exemplary embodiment will be described. In the experiment, transition of the amount of developer in the developing device in the case of successively forming images of an image coverage of 0.5% was studied by using an example, which was a developing device including the magnet 101 as in the present exemplary embodiment, and a comparative example, which was a developing device not including the magnet. The example and the comparative example had the same configuration except for the presence/absence of the magnet 101. The results are shown in FIG. 12.

In the case of an image of an image coverage of 0.5%, the amount of supply of developer is very small, and therefore the amount of developer in the developing device gradually decreases if the amount of discharge from the developing device is large. As can be seen from FIG. 12, whereas the amount of developer gradually decreased as the image formation was continued in the developing device of the configuration of the comparative example, the amount of developer in the developing device was steady even when the image formation was continued in the developing device of the configuration of the example.

As described above, according to the configuration of the present exemplary embodiment, by covering the discharge port 100 by the developer accumulating region 102 formed by the magnet 101, the airflow flowing out through the discharge port 100 can be suppressed, and thus excessive discharge of the developer by the airflow can be suppressed. Therefore, the amount of developer in the developing device can be maintained at an appropriate value even in the case where the amount of developer supplied per unit time is small.

Second Exemplary Embodiment

Figure 13:
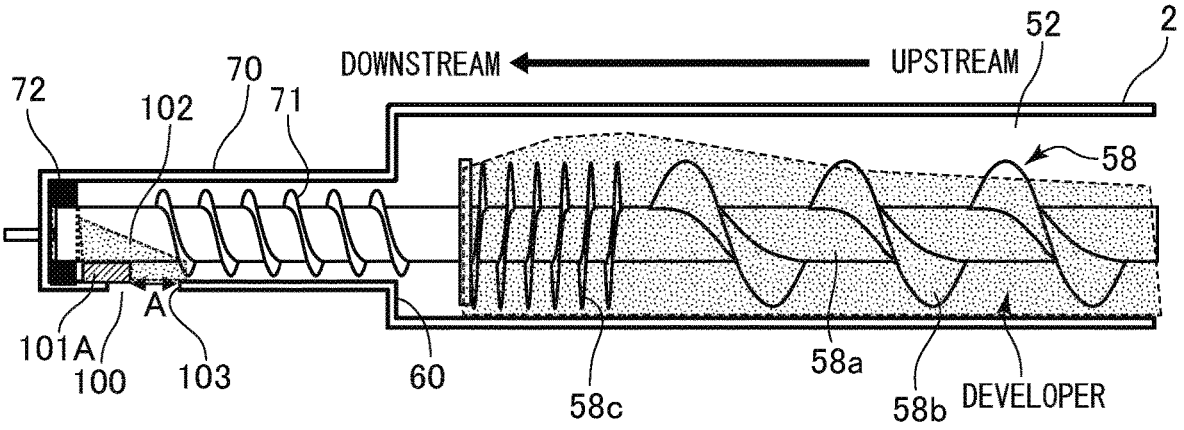
FIG. 13 is a schematic view of a part of a first conveyance path and a discharge path of a developing device according to a second exemplary embodiment.

A second exemplary embodiment will be described with reference to FIG. 13. In the first exemplary embodiment described above, a case where a ring-shaped magnet is used has been described. In contrast, in the present exemplary embodiment, a magnet 101A having a flat plate shape is used. The other elements are the same as in the first exemplary embodiment. Therefore, the same elements are denoted by the same reference signs, and description and illustration thereof will be omitted or simplified. Parts different from the first exemplary embodiment will be mainly described below.

In the present exemplary embodiment, the magnet 101A having a flat plate shape serving as a magnetic field generation is provided at a position away from the upstream end 103 of the discharge port 100 by the interval A. The magnet 101A is fixed to the inner circumferential surface of the discharge path 70 in a range at least including one end to the other end of the opening of the discharge port 100 in the circumferential direction of the rotation shaft 58*a*. To be noted, in the present exemplary embodiment, the magnet 101A is not provided over the entire circumference of the discharge path 70, and therefore an oil seal 72 serving as a sealing member for preventing leakage of developer is provided downstream of the magnet 101A in the discharge path 70. The oil seal 72 is attached to the outer circumferential surface of the rotation shaft 58*a* of the first conveyance screw 58.

Also in the case of the present exemplary embodiment having a configuration described above, the developer accumulating region 102 is formed from the developer attracted and attached to the surface of the magnet 101A by the magnetic force thereof, and the developer accumulating region 102 seals the discharge port 100. Therefore, the flow path for the air to flow out of the developer container 2 through the discharge port 100 is blocked by the developer accumulating region 102, and thus the flow rate of the airflow flowing out can be reduced. Therefore, discharge of the developer to the outside through the discharge port 100 by this airflow can be suppressed.

In addition, although the developer conveyed by the discharge conveyance portion 71 is pushed downstream in the conveyance direction by the conveyance force of the discharge conveyance portion 71, the oil seal 72 serving as a sealing member is provided downstream of the magnet 101A. Therefore, the developer is not conveyed beyond the oil seal 72, and the developer conveyed beyond the magnet 101A is pulled back by the magnetic force of the magnet 101A, and makes up a part of the developer accumulating region 102.

When the amount of developer exceeds an amount that can be borne by the magnetic force of the magnet 101A, the developer is naturally discharged downward through the discharge port 100 by the gravity. In this manner, excessive discharge of the developer by the airflow can be suppressed while the developer is normally discharged by the discharge conveyance portion 71.

As described above, also in the configuration of the present exemplary embodiment, excessive discharge of the developer by the airflow flowing out through the discharge port 100 can be suppressed, and the amount of developer in the developing device can be maintained at an appropriate amount even when the amount of supply of developer per unit time is small.

Third Exemplary Embodiment

A third exemplary embodiment will be described with reference to FIG. 14. In the first and second exemplary embodiments described above, configurations in which a magnet is provided in the discharge path 70 have been described. In contrast, in the present exemplary embodiment, a magnet 101B is provided in a discharge connection path 104 connected to the discharge port 100. The other elements are the same as in the first exemplary embodiment. Therefore, the same elements are denoted by the same reference signs, and description and illustration thereof will be omitted or simplified. Parts different from the first exemplary embodiment will be mainly described below.

First, the discharge connection path 104 serving as a second discharge path is connected to the discharge port 100 of the discharge path 70 serving as a first discharge path. The developer is discharged to the outside through the discharge port 100 and the discharge connection path 104. For example, the discharge connection path 104 is connected to a collection container provided outside for the developer, and the developer discharged through the discharge port 100 is collected into the collection container through the discharge connection path 104. The discharge connection path 104 described above is formed from a nonmagnetic material such as resin. For example, the discharge connection path is integrally formed with the developer container 2 from resin. To be noted, the discharge connection path is normally provided also in the configurations of the first and second exemplary embodiments.

Particularly, in the present exemplary embodiment, the magnet 101B serving as a magnetic field generation portion is provided on the outer wall of the discharge connection path 104. The magnet 101B is formed in a flat plate shape, and is provided on the downstream end side of the discharge port 100 on the outer wall of the discharge connection path 104. To be noted, the magnet 101B may be disposed to cover the entire circumference of the outer wall of the discharge connection path 104, or provided on the upstream end side of the discharge port 100. In addition, the magnet 101B may be provided on the inner wall of the discharge connection path 104. Any case is acceptable as long as the magnet 101B is disposed such that the developer accumulating region 102 formed by the magnetic force of the magnet 101B blocks the discharge connection path 104.

In addition, in the present exemplary embodiment, the magnet 101B is disposed at an upstream end portion of the discharge connection path 104 in the direction in which the developer passes therethrough such that the discharge connection path 104 is blocked by the developer accumulating region 102 in the vicinity of the discharge port 100.

In addition, in the present exemplary embodiment, since the magnet is not provided in the discharge path 70 unlike in the first and second exemplary embodiments, a push-back portion 71*a* for pushing back the developer toward the downstream side of the discharge port 100 is provided. The push-back portion 71*a* is a blade having a spiral shape in a direction opposite to that of the spiral blade of the discharge conveyance portion 71, and conveys the developer in a direction opposite to the developer conveyance direction of the discharge conveyance portion 71. Further, in the present exemplary embodiment, the oil seal 72 is provided on the downstream side, that is, the left side in FIG. 14, of the push-back portion 71*a* as in the second exemplary embodiment.

Also in the case of the present exemplary embodiment having a configuration described above, the developer accumulating region 102 is formed from the developer attracted by the magnetic force of the magnet 101B and attached to the inner circumferential surface of the discharge connection path 104, and the developer accumulating region 102 seals the discharge connection path 104. Therefore, the flow path for the air to flow out of the developer container 2 through the discharge port 100 is blocked by the developer accumulating region 102, and thus the flow rate of the airflow flowing out can be reduced. Therefore, discharge of the developer to the outside through the discharge port 100 by this airflow can be suppressed.

Figure 14:
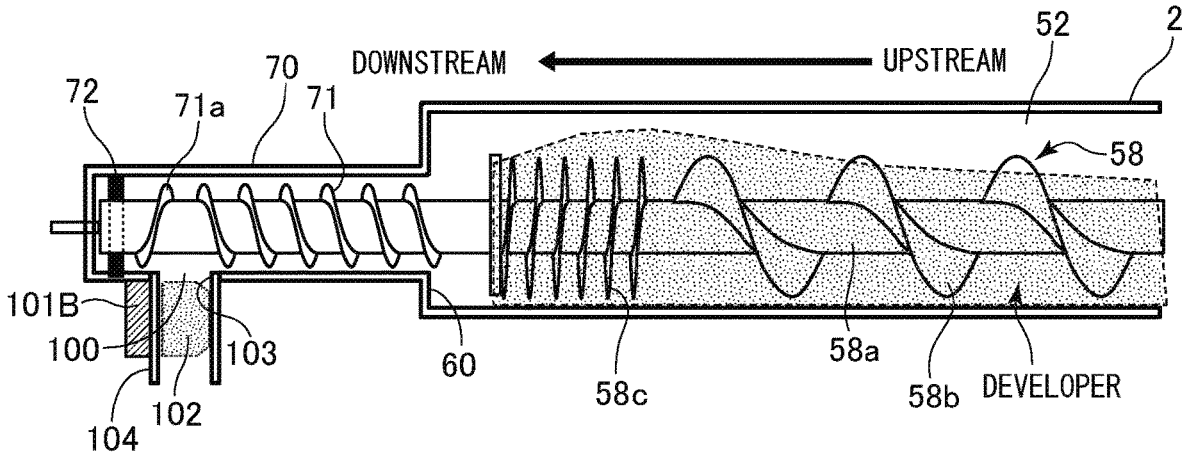
FIG. 14 is a schematic view of a part of a first conveyance path and a discharge path of a developing device according to a third exemplary embodiment.

Although the developer conveyed by the discharge conveyance portion 71 is pushed leftward in FIG. 14 by the conveyance force of the discharge conveyance portion 71, the oil seal 72 serving as a sealing member and the push-back portion 71*a* that pushes back the developer are disposed at the downstream end portion of the discharge port 100. Therefore, the developer is not conveyed beyond the oil seal 72, and is pushed toward the discharge port 100 provided below. When the amount of developer pushed toward the discharge port 100 exceeds an amount that can be borne by the magnetic force of the magnet 101B, the developer is naturally discharged downward through the discharge port 100 by the gravity. In this manner, excessive discharge of the developer by the airflow can be suppressed while the developer is normally discharged by the discharge conveyance portion 71. To be noted, the push-back portion 71*a* may be omitted.

As described above, also in the configuration of the present exemplary embodiment, excessive discharge of the developer by the airflow flowing out through the discharge port 100 can be suppressed, and the amount of developer in the developing device can be maintained at an appropriate amount even when the amount of supply of developer per unit time is small.

Fourth Exemplary Embodiment

A fourth exemplary embodiment will be described with reference to FIGS. 15 to 19. In the first and second exemplary embodiments, configurations in which a magnet is provided downstream of the upstream end 103 of the discharge port 100 have been described. In contrast, in the present exemplary embodiment, a magnet 101C is provided upstream of the upstream end 103 of the discharge port 100. The other elements are the same as in the first exemplary embodiment. Therefore, the same elements are denoted by the same reference signs, and description and illustration thereof will be omitted or simplified. Parts different from the first exemplary embodiment will be mainly described below.

Figure 15:
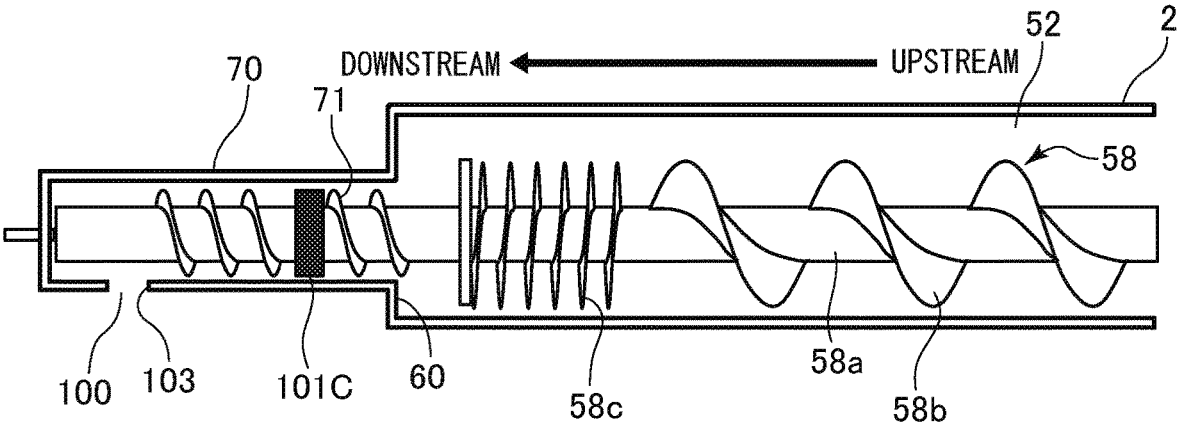
FIG. 15 is a schematic view of a part of a first conveyance path and a discharge path of a developing device according to a fourth exemplary embodiment.

In the present exemplary embodiment, as illustrated in FIG. 15, part of the blade of the discharge conveyance portion 71 is cut out, and a magnet 101C serving as a magnetic field generation portion is fixed to the entire circumference of the rotation shaft 58*a*. Specifically, a magnet 101C having a flat plate shape is fixed to the rotation shaft 58*a* by winding and sticking the magnet 101C around and to the entire circumference of the rotation shaft 58*a*. The developer borne on the outer circumferential surface of the magnet 101C forms a magnetic brush between the rotation shaft 58*a* and the inner circumferential surface of the discharge path 70. As a result of this, the flow path of the air in the discharge path 70 is blocked by the magnetic brush.

The sticking position of the magnet 101C in the longitudinal direction, that is, the axial direction of the rotation shaft 58*a*, is downstream of the reverse conveyance portion 58*c* in the first direction. The reason for this is as follows. If the magnet 101C is disposed upstream of the reverse conveyance portion 58*c* in the first direction and the magnetic brush is formed at a position upstream of the reverse conveyance portion 58*c*, the flow path of air flowing through the discharge port 100 cannot be sufficiently blocked, and excessive discharge of the developer cannot be sufficiently suppressed.

In addition, a configuration in which a middle portion of the blade of the reverse conveyance portion 58*c* is cut out and the magnet 101C is provided therein can be also considered. However, since the reverse conveyance portion 58*c* is a member that conveys the developer upstream in the first direction, the sealing of the magnetic brush cannot be overcome even when the volume of the developer has increased, and therefore the performance of discharging the developer is degraded. Described above are the reasons for setting the sticking position of the magnet 101C to be downstream of the reverse conveyance portion 58*c* in the longitudinal direction. To be noted, although the magnet 101C may be provided in the first conveyance path 52 as long as the magnet 101C is provided downstream of the reverse conveyance portion 58*c* in the first direction, it is preferable that the magnet 101C is disposed in the discharge path as in the present exemplary embodiment.

Figure 16A:
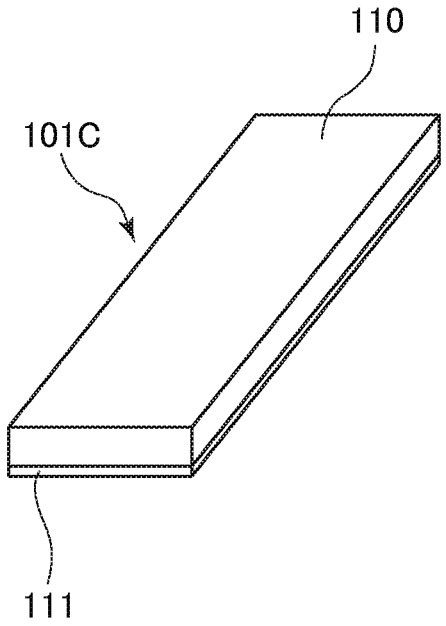
FIG. 16A is a perspective view of a magnet according to a fourth exemplary embodiment in a spread state.
Figure 16B:
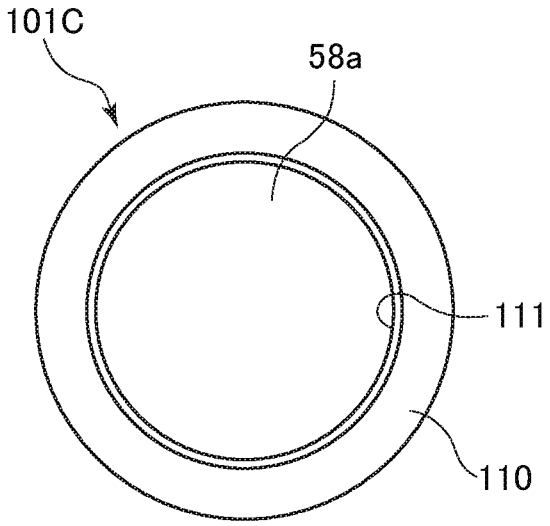
FIG. 16B is a section view of the magnet according to the fourth exemplary embodiment.

FIG. 16A is a perspective view of the magnet 101C, and FIG. 16B is a section view of the magnet 101C taken along the axial direction of the rotation shaft 58*a*. The magnet 101C is constituted by a magnet member 110 that is flexible and has a plate shape, and a sticking surface 111 of a double-sided tape stuck to one surface of the magnet member 110. The magnet 101C has a length equal to the length of the circumference of the rotation shaft 58*a* such that there is no gap between the magnet 101C and the rotation shaft 58*a* in section view when the magnet 101C is wound around the rotation shaft 58*a*.

Figure 17:
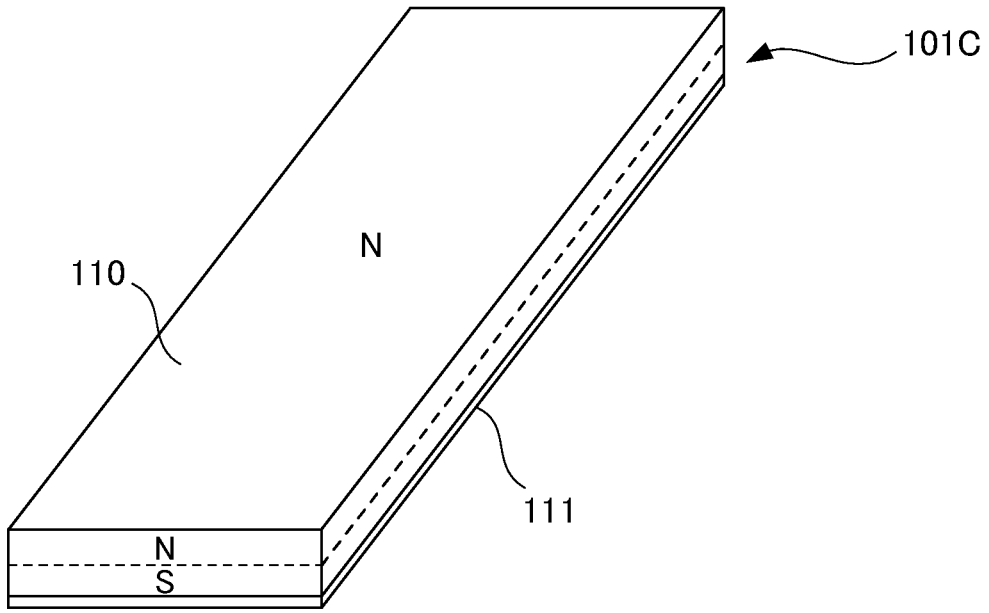
FIG. 17 is a perspective view of the magnet according to the fourth exemplary embodiment illustrating arrangement of magnetic poles thereof.

FIG. 17 illustrates a magnetization pattern of the magnet 101C in the present exemplary embodiment. Both surfaces of the magnet 101C having a plate shape are magnetized, the sticking surface 111 side is an S pole, and the front surface is an N pole. However, the direction of the poles may be reversed.

The outer diameter of the rotation shaft 58*a* at the position where the magnet 101C is stuck is preferably designed to be an appropriate value in accordance with the magnitude of the magnetic force and the thickness of the magnet 101C. Since the size of the nap of the magnetic brush depends on the magnitude of the magnetic force of the magnet 101C, it is preferable that the width of the gap between the magnet 101C and the discharge path 70 is maintained at an appropriate value for blocking the flow path of air by the magnetic brush. In the case where the gap between the magnet 101C and the discharge path 70 is too narrow for the magnitude of the magnetic force, excess developer is not sufficiently discharged when the volume of the developer increases. Conversely, in the case where the magnetic force is too weak, a sufficient sealing property is not obtained, and the airflow cannot be blocked. In the present exemplary embodiment, the gap between the outer circumferential surface of the magnet 101C and the inner circumferential surface of the discharge path 70 is set to 1 mm or more.

In addition, in the present exemplary embodiment, a magnet having a thickness of 1.0 mm, a width of 3 mm, and a surface magnetic force of 60 mT as measured with GX-100 manufactured by Nihon Denji Sokki Co., Ltd. was used as the magnet 101C. The height of the nap of the magnetic brush was calculated as an average nap height from an image three-dimensionally obtained by using a 3D laser microscope VK-8700 manufactured by Keyence. The average nap height measured for the magnet 101C was 1.2 mm. Therefore, the width of the gap between the magnet 101C and the discharge path 70 was set to 1 mm by setting the outer diameter of the rotation shaft 58*a* to 8 mm and the inner diameter of the discharge path 70 to 12 mm at the position where the magnet 101C was stuck on the rotation shaft 58*a*, such that the magnetic brush contacts the inner wall of the discharge path 70 to block the airflow.

Figure 18A:
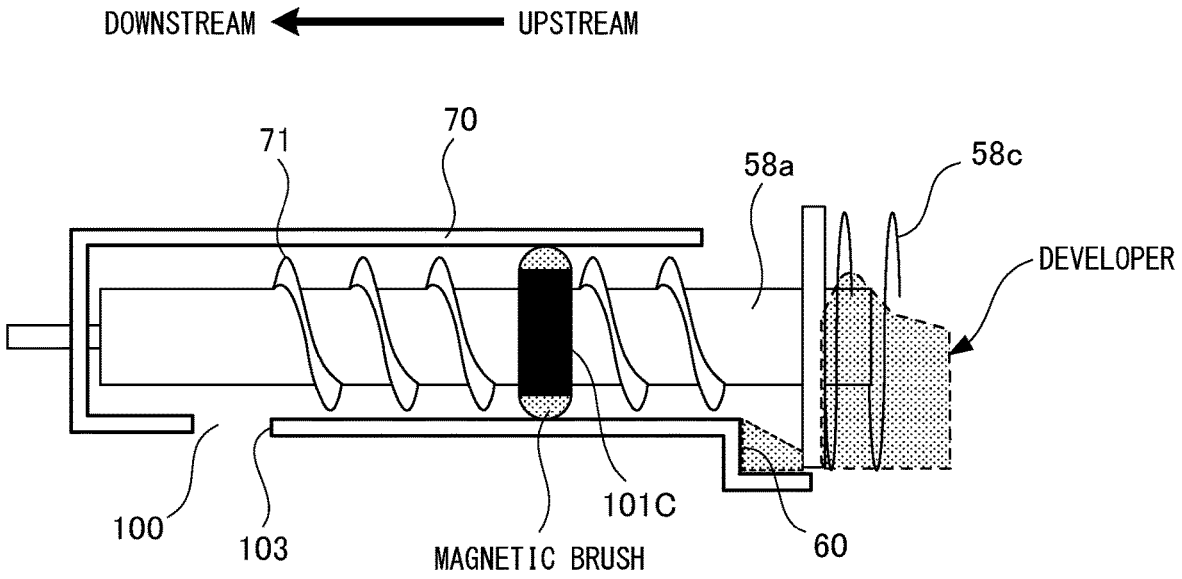
FIG. 18A is a schematic diagram illustrating a state in which the developer surface is low.

Next, a mechanism for discharging the developer in the present exemplary embodiment will be described. FIG. 18A illustrates a developer surface when the volume of the developer is small, and FIG. 18B illustrates a developer surface when the volume of the developer is large.

Figure 18B:
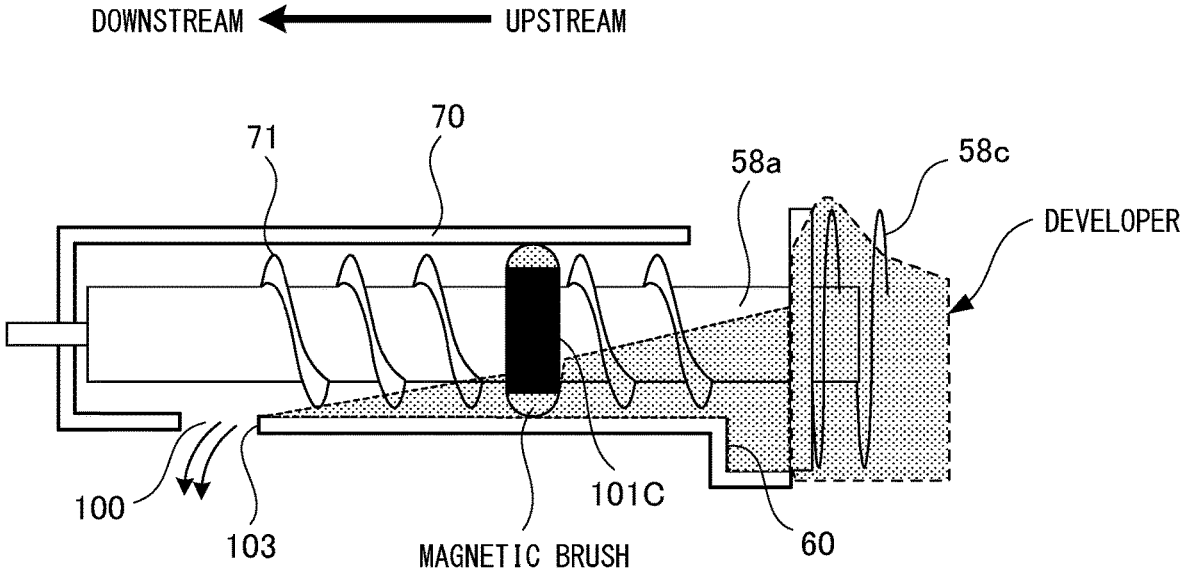
FIG. 18B is a schematic diagram illustrating a state in which the developer surface is at a certain height or higher.

Considering a state in which a certain amount of developer has been already discharged by the trickle developing system, a magnetic brush following a magnetic force line is formed around the magnet 101C as illustrated in FIGS. 18A and 18B. As illustrated in FIG. 18A, in the case where the volume of the developer is small, since the magnetic brush formed around the magnet 101C blocks the path for the air to flow to the discharge port 100, the airflow illustrated in FIG. 7 is not generated, or even if generated, the flow rate of the air is reduced. Therefore, the developer seldom reaches the discharge path 70, and excessive discharge of the developer is not likely to occur.

In contrast, as illustrated in FIG. 18B, in the case where the volume of the developer is large, the developer not pushed back by the reverse conveyance portion 58*c* reaches the discharge path 70, and is conveyed downstream by the discharge conveyance portion 71. When the amount of conveyed developer increases and the developer pressure increases, the developer is conveyed to the most downstream side by overcoming the binding force of the magnetic brush, and reaches the discharge port 100 to be discharge as excess developer.

To be noted, although the discharge conveyance portion 71 is also present downstream of the magnet 101C, the discharge conveyance portion 71 does not have to be provided downstream of the magnet 101C if the magnet 101C is close to the discharge port 100. That is, it suffices as long as the discharge conveyance portion 71 is provide at least upstream of the magnet 101C.

As described above, by sealing the gap between the discharge path 70 and the rotation shaft 58*a* by the magnetic brush by the magnet 101C, excessive discharge of the developer by the airflow can be effectively suppressed without degrading the performance of discharging the developer.

Figure 19A:
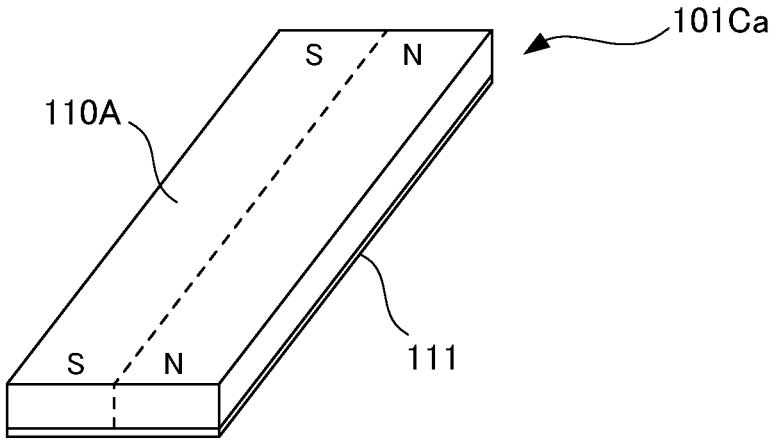
FIG. 19A is a perspective view of a first alternative example of a magnet.
Figure 19B:
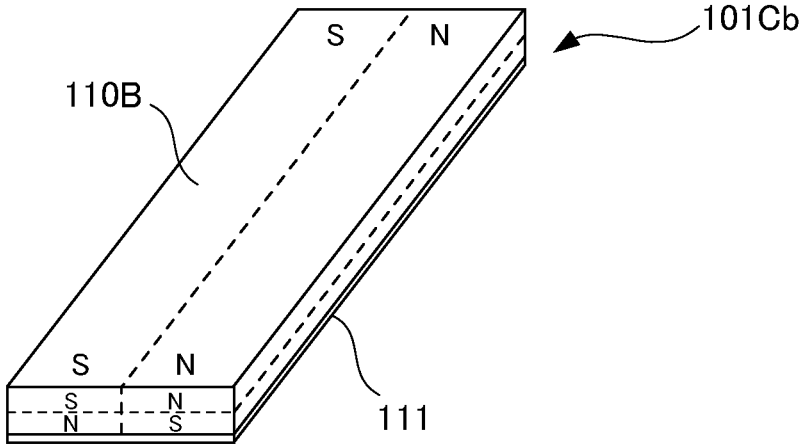
FIG. 19B is a perspective view of a second alternative example of the magnet.
Figure 19C:
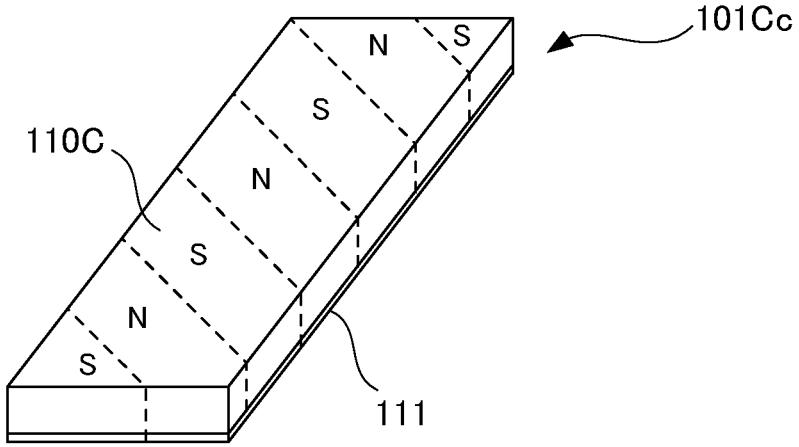
FIG. 19C is a perspective view of a third alternative example of the magnet.

To be noted, the magnetization pattern of the magnet 101C is not limited to the magnetization pattern illustrated in FIG. 17, and various modes can be considered. FIGS. 19A to 19C illustrate examples of the magnetization pattern. In a magnet 101Ca of FIG. 19A, the magnetization pattern of a magnet member 110A is arranged not in a front-back direction but in a longitudinal direction. In a magnet 101Cb of FIG. 19B, magnetization is performed further on the front surface and the back surface of a magnet member 110B in addition to the state illustrated in FIG. 19A. In a magnet 101Cc of FIG. 19C, N poles and S poles are formed on the front surface of a magnet member 110C in an oblique stripe shape. Also in the case of these patterns, excessive discharge of the developer by the airflow can be effectively suppressed by the magnetic brush in contact with the discharge path 70.

Various magnetization patterns other than ones exemplified in FIGS. 19A to 19C can be also considered. It goes without saying that the effect of the present invention can be substantially obtained as long as the magnetic brush is in contact with the inner wall of the discharge path 70.

Fifth Exemplary Embodiment

Figure 20:
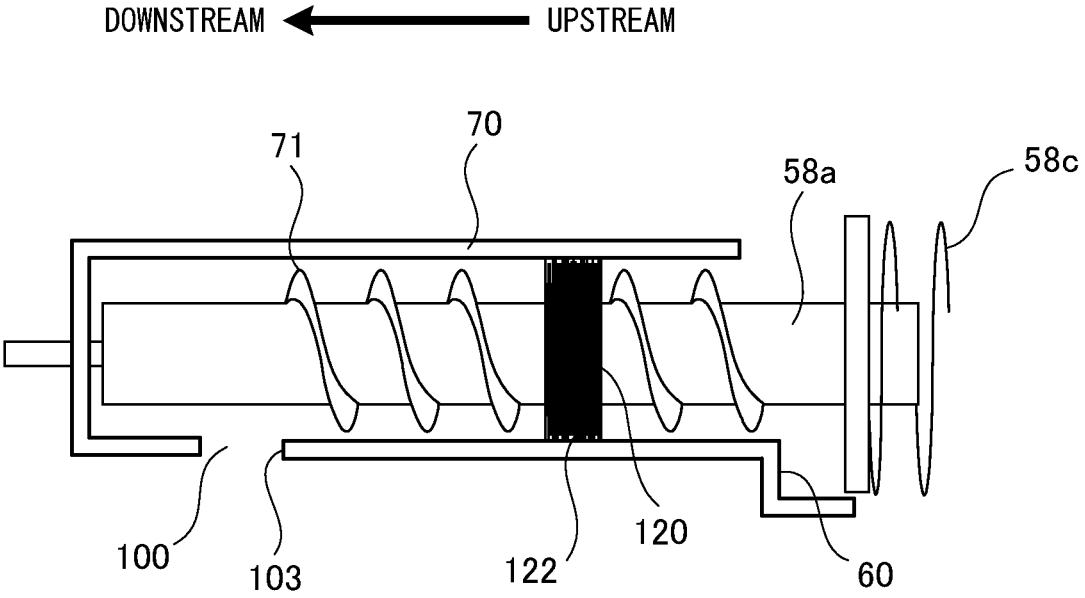
FIG. 20 is a schematic view of a part of a first conveyance path and a discharge path of a developing device according to a fifth exemplary embodiment.

A fifth exemplary embodiment will be described with reference to FIGS. 20 and 21. In the fourth exemplary embodiment, a configuration in which a magnetic brush is formed by a magnet has been described. In contrast, in the present exemplary embodiment, a brush member 120 is provided instead of a magnetic brush formed by a magnet. The other elements are the same as in the fourth exemplary embodiment. Therefore, the same elements are denoted by the same reference signs, and description and illustration thereof will be omitted or simplified. Parts different from the fourth exemplary embodiment will be mainly described below.

The brush member 120 is provided over the entire circumference between the rotation shaft 58*a* and the inner wall of the discharge path 70. In the present exemplary embodiment, as illustrated in FIG. 20, part of the blade of the discharge conveyance portion 71 is cut out, and the brush member 120 is fixed to the entire circumference of the rotation shaft 58*a*. The fixing position of the brush member 120 is similar to the fixing position of the magnet 101C of the fourth exemplary embodiment.

Figure 21:
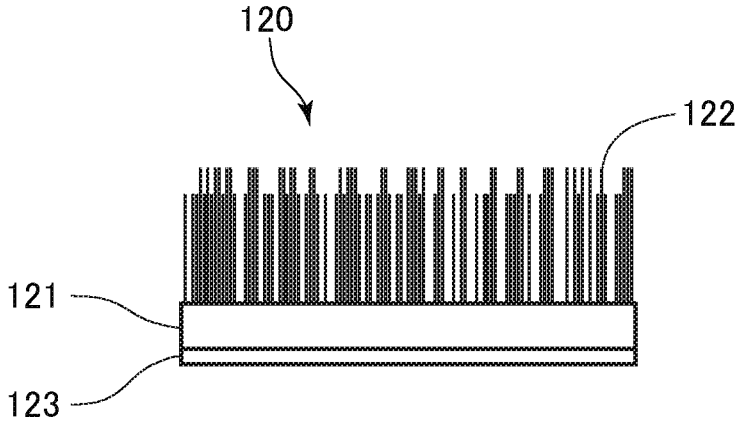
FIG. 21 is a section view of a brush member according to the fifth exemplary embodiment.

The brush member 120 is formed by planting fibers 122 on one surface of a flexible substrate 121 and sticking a double-sided tape 123 on the other surface of the substrate 121 to form a sticking surface as illustrated in FIG. 21, and is fixed to the rotation shaft 58*a* by being wound therearound. Also in the present exemplary embodiment having a configuration described above, the naps of the fibers 122 come into contact with the inner wall of the discharge path 70 as illustrated in FIG. 20. To be noted, the brush member 120 may be fixed to the inner wall of the discharge path 70 such that the brush member 120 comes into contact with the outer circumferential surface of the rotation shaft 58*a*.

The present exemplary embodiment is different from the fourth exemplary embodiment in that not a magnetic brush but planted fibers are used for sealing the path through which the air flows, but the mechanism for suppressing the excessive discharge of excess developer in the present exemplary embodiment is the same as in the fourth exemplary embodiment. In addition, also in the present exemplary embodiment, excessive discharge of the developer by the airflow can be effectively suppressed similarly to the fourth exemplary embodiment.

Other Embodiments

Although configurations in which the image forming apparatus is a printer have been described in the above exemplary embodiments, the present invention is also applicable to copiers, facsimile machines, multifunctional apparatuses, and so forth. In addition, configurations in which, in the developing device, developer is supplied from a developing chamber, that is, the second conveyance path 53 serving as a second chamber, and is collected from the developing sleeve into the developing chamber have been described in the above exemplary embodiments. However, the present invention is also applicable to a configuration in which developer is supplied from a developing chamber and is collected into an agitation chamber, that is, the first conveyance path 52 serving as a first chamber, provided with a partition wall between the agitation chamber and the developing chamber. Further, in addition to a configuration in which the first chamber and the second chamber are arranged in the horizontal direction, the present invention is also applicable to a configuration in which the first chamber and the second chamber are arranged in the up-down direction or a direction inclined with respect to the horizontal direction. To be noted, the first chamber may serve as a developing chamber and the second chamber may serve as an agitation chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-161570, filed Sep. 4, 2019, which is hereby incorporated by reference herein in its entirety.

What is claimed is:

1. A developing device comprising:

a developer bearing member configured to bear and convey a developer containing toner and carrier for developing an electrostatic latent image formed on an image bearing member;

a developer container comprising a first chamber and a second chamber and configured to accommodate the developer supplied to the developer bearing member, the second chamber being partitioned from the first chamber by a partition wall;

a first conveyance screw comprising a first blade portion and a second blade portion, the first blade portion being disposed in the first chamber and configured to convey the developer in a first direction, the second blade portion being disposed downstream of the first blade portion in the first direction in the first chamber and configured to convey the developer in a second direction opposite to the first direction to deliver the developer from the first chamber to the second chamber;

a second conveyance screw disposed in the second chamber and configured to convey the developer in the second direction;

a discharge path which is disposed downstream of the second blade portion in the first direction, comprising a discharge port for discharging part of the developer accommodated in the developer container from the developing device, and is connected to a downstream end of the first chamber in the first direction, and through which the developer passes to be discharged through the discharge port; and a magnet, wherein the first conveyance screw further comprises a third blade portion disposed in the discharge path and downstream of the second blade portion in the first direction and configured to convey the developer in the first direction, wherein the discharge port is disposed downstream of an upstream end of the third blade portion in the first direction, and wherein the magnet is disposed downstream of an upstream end of the discharge port in the first direction so as to overlap with the discharge port in the first direction.

2. The developing device according to claim 1, wherein the magnet is disposed downstream of a downstream end of the third blade portion in the first direction.

3. The developing device according to claim 1, wherein a downstream end of the third blade portion is disposed downstream of an upstream end of the discharge port in the second direction.

4. The developing device according to claim 1, wherein the magnet is fixed to an inner wall surface of the discharge path.

5. The developing device according to claim 4, wherein the magnet is a ring-shaped magnet, and a gap is provided between the magnet and an outer circumferential surface of a rotation shaft of the first conveyance screw.

6. The developing device according to claim 1, wherein a magnetic flux density of the magnet is 50 mT to 60 mT.

7. The developing device according to claim 1, further comprising an oil seal disposed downstream of the third blade portion in the first direction and attached to an outer circumferential surface of a rotation shaft of the first conveyance screw, wherein the magnet is disposed upstream of the oil seal in the first direction.

8. The developing device according to claim 1, wherein a bottom surface of the discharge path is positioned higher than a bottom surface of the first chamber in a vertical direction.

9. The developing device according to claim 1, wherein an outer diameter of the third blade portion is smaller than an outer diameter of the first blade portion.

10. The developing device according to claim 1, wherein the developer is supplied to the developer bearing member from the second chamber.

* * * * *